US005992789A

United States Patent [19]

Lamothe

[11] Patent Number: 5,992,789

[45] Date of Patent: Nov. 30, 1999

[54] CONTROL SYSTEM FOR UNWIND MACHINE

[75] Inventor: Richard P. Lamothe, Burlington, Conn.

[73] Assignee: Energy Saving Products and Sales Corporation, Burlington, Conn.

[21] Appl. No.: 08/736,199

[22] Filed: Aug. 27, 1996

Related U.S. Application Data

[60] Provisional application No. 60/003,365, Nov. 22, 1995.

[51] Int. Cl.[6] ..... B65H 23/192

[52] U.S. Cl. ..... 242/418.1; 226/42; 226/112; 242/417.2

[58] Field of Search ..... 242/412.2, 413.1, 242/418.1, 417.2, 420.3; 226/108, 111, 112, 113, 114, 118.1, 118.2, 118.3, 42, 44

[56] References Cited

U.S. PATENT DOCUMENTS

| | | | |
|---|---|---|---|
| 2,105,824 | 1/1938 | Simonds | 242/418.1 |
| 3,258,261 | 6/1966 | Vath et al. | 226/112 |
| 3,870,215 | 3/1975 | Schiffer | 226/118.3 |
| 5,188,580 | 2/1993 | Rutledge et al. | 226/118.1 |
| 5,320,266 | 6/1994 | Noe et al. | 226/118.3 |

*Primary Examiner*—John M. Jillions

*Attorney, Agent, or Firm*—McCormick, Paulding & Huber LLP

[57] ABSTRACT

An unwind machine has three tension free loops between the paper roll that is unwinding and the utilization device that must be fed paper at a rate that varies widely. One loop is conventionally controlled, and the other loops act in sequence to accommodate progressively larger ranges of web speed at the utilization device while maintaining rotational speed changes at the paper roll within reasonable limits.

4 Claims, 2 Drawing Sheets

CONTROL SYSTEM FOR UNWIND MACHINE

CROSS REFERENCE TO RELATED APPLICATIONS

This application is related to an application entitled MACHINE FOR MANIPULATING WEB MATERIAL, Ser. No. 218,512, filed Mar. 25, 1994, by the same inventor said application has since issued as U.S. Pat. No. 5,505,401 this case also claims Benefit of Provisional application Ser. No. 60/803,385 filed Nov. 22, 1995.

BACKGROUND OF THE INVENTION

1. Field of the Invention

This invention relates generally to unwind machines of the type adapted to deliver a paper web from a paper roll to a utilization device such as a laser printer, and to accommodate abrupt changes in the speed of the paper web in the laser printer.

2. Description of Prior Art

In order to accommodate the wide range of speed changes that a laser printer requires, unwind machines feed the paper web into the laser printer from a roll of paper web material and a free loop of the web material is provided between the laser printer and the paper roll. The paper roll is unwound by a driven belt or roller, which is driven at a variable speed in response to the output signal from an ultrasonic sensor that provides an indication of the depth of the free loop of the paper web. The free loop is formed between a driven roller and an idler roller provided one on each side of this free loop. The speed of the belt which unwinds the paper web from the roll is varied in direct proportion to the input provided from an ultrasonic or photocell type sensor in accordance with known control systems generally. The reader is referred to Waddington U.S. Pat. No. 4,484,655 and Meschi U.S. Pat. No. 5,234,146. for a more complete description of such prior art systems.

Present day laser printers require such a wide range of speed changes that unwind systems such as that described above have difficulty in accommodating the speed changes of the paper roll that must be accommodated. That is, the paper roll has considerable inertia, and once rotated at a particular speed requires considerable braking by, or acceleration of, the driven roller or belt that may be beyond the capabilities of present day unwind machines. There is a need for reducing the abrupt speed changes at the unwind roll itself when the laser printer either stops the paper web or in some cases, actually reverses the direction of its movement.

SUMMARY OF THE INVENTION

The general purpose and object of the invention is to provide an improved control system for an unwind machine that provides improved response to the large changes in the speed of the paper web that are required in the utilization device such as a high speed laser printer.

This object is accomplished with the present invention by providing a plurality of driven rollers that are oriented in series with respect to one another and in spaced relationship to one another so as to define a plurality of tension free loops of the paper web between the paper roll and the utilization device. A plurality of ultrasonic sensors is arranged to generate signals proportional to the depth of each associated paper web loop. Thus, each driven roller responds to changes in the depth of back tension free loop by reason of it's associated sensor output. Only one loop may be required to accommodate a relatively modest timed speed differential between the paper roll and the utilization device. More than one loop provides an even wider range of changes in speed as required in the event the laser printer either slows down or speeds up beyond the modest speed differential that can be accommodated with a single tension free loop.

BRIEF DESCRIPTION OF THE DRAWINGS

A more complete understanding of the invention and many of its intended advantages will be appreciated as the same become better understood by the following detailed description when considered in conjunction with the accompanying drawings wherein.

DESCRIPTION OF THE PREFERRED EMBODIMENT

Figure 1:
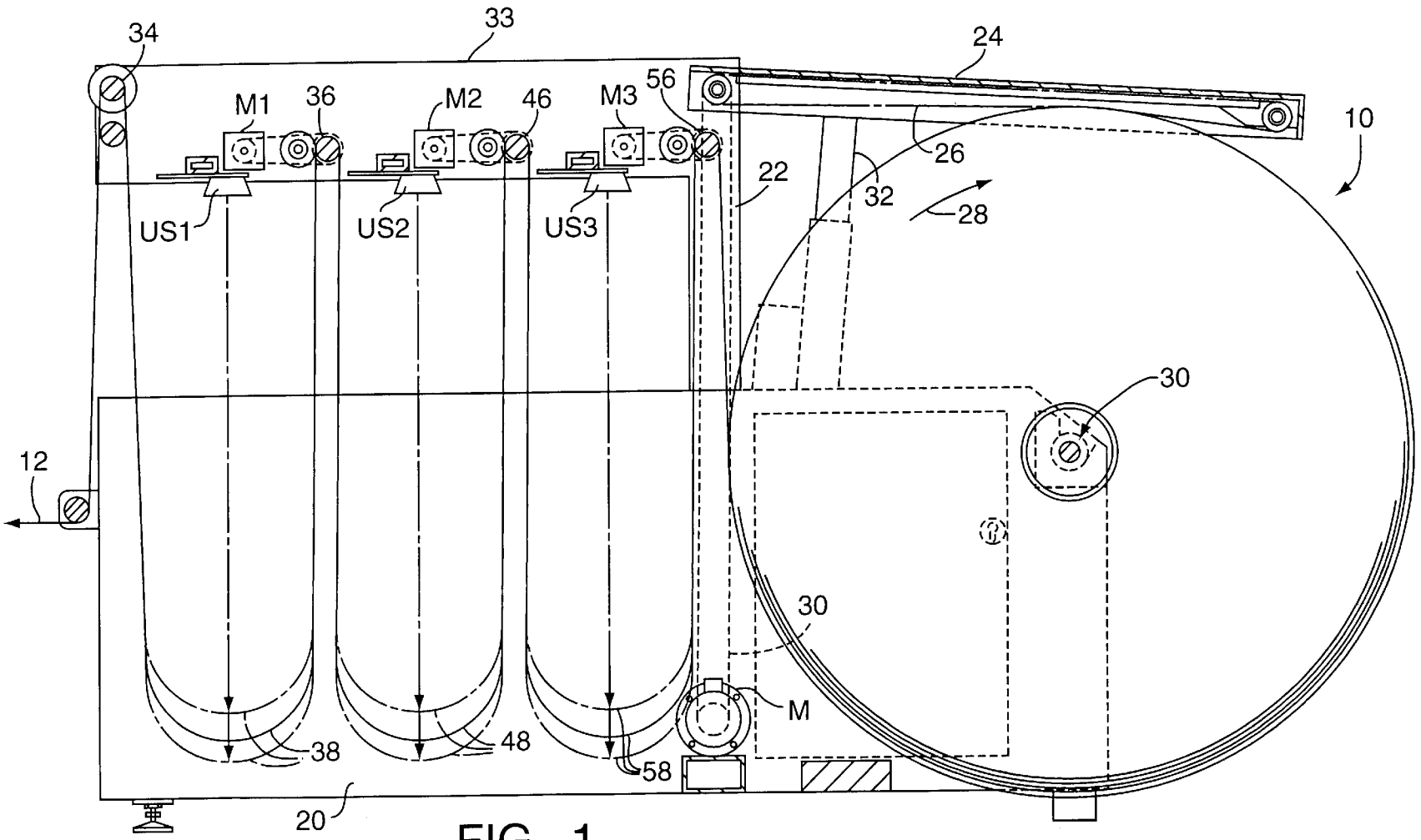
FIG. 1 shows in schematic fashion and in vertical elevation an unwind machine equipped with the present invention.

Referring now to FIG. 1, there is shown an improved unwind machine equipped with a control system constructed in accordance with the present invention. The unwind machine accommodates a roll of the web material, as indicated generally at 10, and provides for the movement of the web from the roll into a utilization device (not shown but suggested by the arrow 12) associated with the downstream end of the paper web.

The mechanism for unwinding the roll and forming the first of the three tension free loops shown may be similar to that described in my above mentioned copending patent application, and the content of that application is incorporated by reference herein so as to avoid unnecessary descriptive material which is readily accessible from the disclosure in that prior filed application.

For reference purposes, the unwind machine shown includes a frame 20 that is adapted to rotatably support the opposed end portions of a roll core shaft indicated generally at 30 so that the paper roll is free to rotate on bearings that are provided on each end of this roll core shaft. The frame 20 includes uprights 22 which pivotably support a beam 24 adjacent the upper ends thereof. The beam 24 supports a driven belt 26 that engages the periphery of the roll 10 in order to drive the roll 10 in the direction of the arrow 28. The driven belt 26 is driven from a variable speed drive motor M through an intermediate belt 30 contained within one of the upright supports 22 for this purpose. The pivoted beam 24 is constrained in its movement relative to the paper roll 10 by a shock absorber or damper 32 that is provided for this purpose between the machine frame and the pivoted beam 24. The machine frame includes a fixed cantilevered beam 32 that extends in the opposite direction from that of the pivoted beam 24 and which supports at its extreme end portion an idler roller 34 that the paper web passes over prior to being received by the utilization device. A driven roller 36 is provided opposite to the idler roller 34 so as to form a tension free loop 38 of paper web between the idler roller 34 and the driven roller 36. An ultrasonic sensor US1 is provided between the idler roller 34 and the driven roller 36 in order to sense the depth of the tension free loop as suggested in FIG. 1. In a typical unwind machine, the depth of this loop varies in response to changes in the speed of the web at the laser printer, and these changes in depth of the tension free loop are utilized to vary the speed of the motor M and hence, the speed of the paper roll 10 coming off the web.

In accordance with the present invention, additional tension free loops 48 and 58 are provided between the first tension free loop 38 and the roll 10, each of which additional tension free loops is provided with an associated ultrasonic sensor US2 and US3 respectively.

Figure 2:
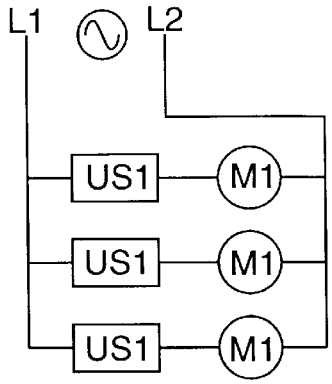
FIG. 2 is a schematic view illustrating a series of three loops and ultrasonic detectors in association with their respective driven rollers.

Turning next to FIG. 2 of the drawings, it can be seen that the first ultrasonic sensor US1 directly operates the motor Ml which in turn directly controls operation of the driven roll 36 which is associated with the first tension free loop 38. In the event this first tension free loop 38 fails to accommodate speed changes over a time increment, the depth of the second tension free loop 48 will change. This second loop has its depth controlled by a second motor M2 which operates a second driven roller 46 associated with this second tension free loop 48 to accommodate a second time/speed range beyond that possible with the first loop 38.

Figure 3:
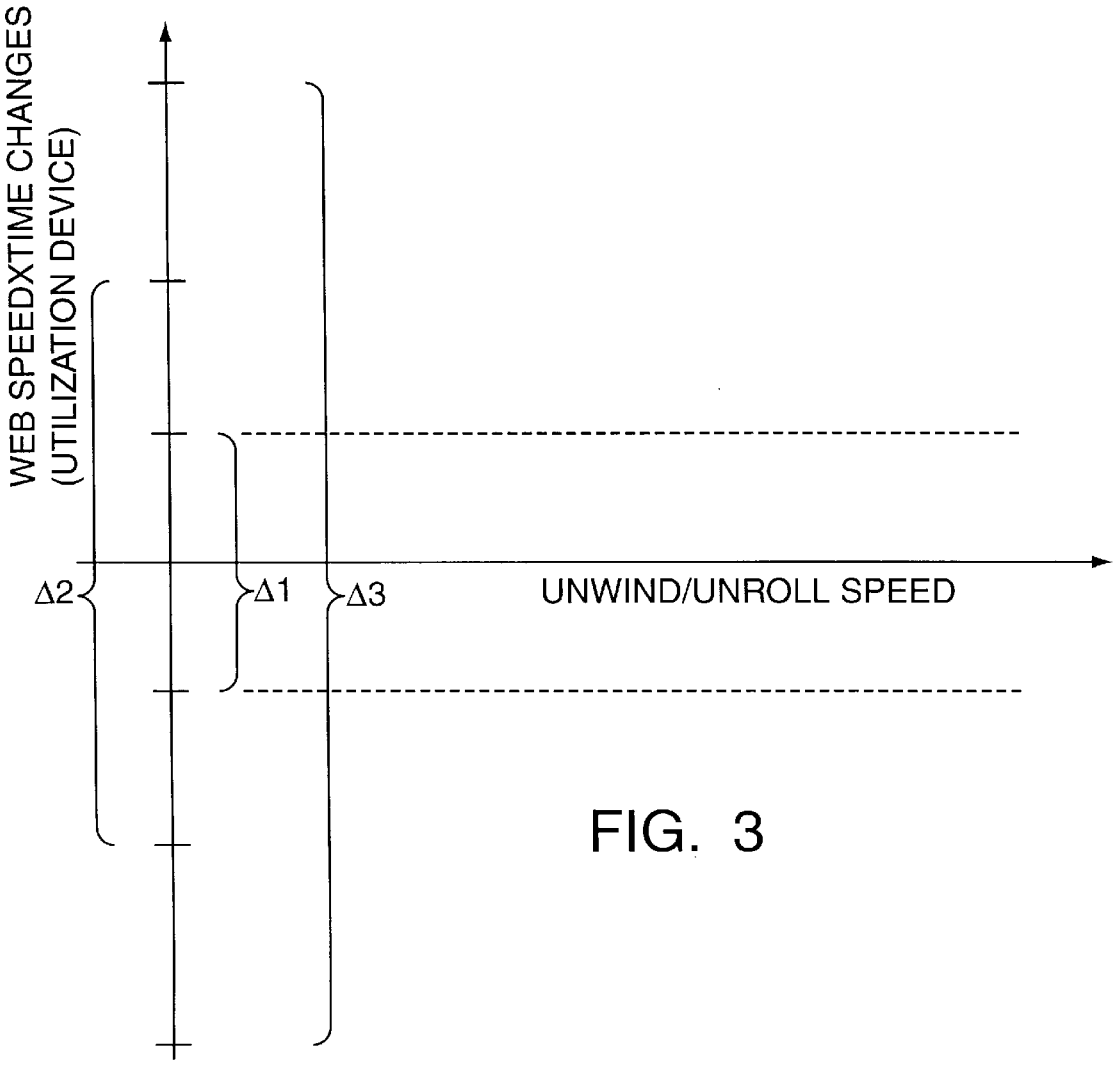
FIG. 3 is a graphical illustration of the differentials in speed that can be accommodated with a system in accordance with the present invention.

A third tension free loop 58 is also provided, and the resulting three tension free loops 38, 48, and 58 operate sequentially as required to accommodate a relatively wide time/speed range that in fact, can accommodate not only stopping of the web at the utilization device but which can actually accommodate reversing the direction of movement of the paper web 12 at least for short periods of time. FIG. 3 shows the time/speed differentials made possible by a control system according to the present invention wherein the first or nominal time/speed range Δ1 is accommodated with a single tension free loop 38. The second time/speed differential Δ2 is made possible by the second tension free loop 48. Finally, the third differential Δ3 is made possible by reason of the three tension free loops and associated driven rollers and sensors all as operated in a sequential fashion as disclosed herein.

Obviously, many modifications and variations of the present invention may become apparent in light of the above teachings. For example, the plurality of tension free loops may number two or more where the inertia of the web material roll being handled in the unwind machine and the relative time/speed changes required at the utilization device dictate more than two tension free loops. Further, ultrasonic sensors are shown as the preferred detection device for providing a continuous indication of the depth of each tension free loop. However, other equivalent devices may be utilized for this purpose. Finally, although the invention has been described in the environment of an unwind machine, it will be apparent that the advantages realized could also be accommodated in a rewind machine of the type provided at the outlet or downstream end of the laser printer or the utilization device. In the envisionment of a rewind machine the first tension free loop would also be adjacent to the laser printer. The reader is referred to the above-identified copending application incorporated by reference herein for a more complete description of such a rewind machine generally.

In light of the above, it is therefore understood that within the scope of the appended claims, the invention may be practiced otherwise than as specifically described.

What is claimed is:

1. A control system for a machine of the type adapted to accommodate a roll of web material and which responds to changes in the speed of that paper web between the roll and a utilization device, said system comprising:

a plurality of driven rollers provided in space relationship to one another and defining of a plurality of depending tension free loops of the web material between the roll of web material and the utilization device, a plurality of sensors so arranged that each sensor generates signals proportional to the depth of an associated one of said paper web loops, each driven roller responding to changes in the depth of an associated tension free loop to vary the rotational speed of each driven roller in proportion to such loop depth changes, said sensors and tension free loops operating sequentially so that only one of said plurality of sensors accommodates a first web timed speed differential between the paper roll and the utilization device, whereby more than one such sensor provides for a wider range of timed speed changes.

2. The system according to claim 1 wherein said machine comprises an unwind machine, and wherein one of said tension free loops associated with said one of said plurality of sensors is provided adjacent the utilization device.

3. The combination of claim 1 wherein said sensors comprise ultrasonic sensors one of which operates one of said driven rollers, and a second sensor for operation of a second driven roller.

4. The system according to claim 3 wherein an idler roller is provided to define a downstream end of the first tension free loop, and wherein said other tension free loop is defined between said one and said second driven rollers associated with said one and said second tension free loops.

* * * * *